US006358013B1

(12) United States Patent
Rose et al.

(10) Patent No.: US 6,358,013 B1
(45) Date of Patent: Mar. 19, 2002

(54) TURBINE BLADE AND MANUFACTURE THEREOF

(75) Inventors: Martin G Rose; Alec G Dodd, both of Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/669,719

(22) Filed: Sep. 26, 2000

(30) Foreign Application Priority Data

Oct. 12, 1999 (GB) ..... 9923983

(51) Int. Cl.[7] ..... F03B 3/12
(52) U.S. Cl. ..... 416/229 A; 416/230; 415/914
(58) Field of Search ..... 416/224, 229 A, 416/230, 241 B; 415/914

(56) References Cited

U.S. PATENT DOCUMENTS 3,779,338 A * 12/1973 Hayden et al. ..... 416/230
4,789,304 A * 12/1988 Gustafson et al. ..... 416/230
4,806,077 A * 2/1989 Bost ..... 416/229 R
5,401,138 A * 3/1995 Mosiewicz ..... 416/226
6,139,268 A * 10/2000 Murawski et al. ..... 415/914

FOREIGN PATENT DOCUMENTS

GB 789883 6/1958
GB 1436724 5/1976

* cited by examiner

*Primary Examiner*—Edward K. Look
*Assistant Examiner*—Igor Kershteyn
(74) *Attorney, Agent, or Firm*—W. Warren Taltavull; Manelli Denison & Selter PLLC

(57) ABSTRACT

A gas turbine blade (10) which has a rounded trailing edge (18), is provided with a row of side by side arranged ceramic fibres (20) along the trailing edge (18). During operation of the turbine blade (10), the rounded shape of trailing edge (18) causes gasflows to break from the rounded edge before reaching the edge extremity. The presence of the fibres (20) prevent the formation of vortices in the gasflow, and thereby improve turbine efficiency.

10 Claims, 1 Drawing Sheet

TURBINE BLADE AND MANUFACTURE THEREOF

BACKGROUND OF THE INVENTION

The present invention relates to a gas turbine engine turbine blade having improved gasflow shedding capability.

The present invention also relates to a method of manufacturing said turbine blade.

Present day gas turbine engines operate at extremely high temperatures, eg 1400 C. It follows, that the material from which the turbine blades are manufactured, must be capable of operating in those temperatures for a considerable period of time, in order to ensure commercial viability of the associated engine.

Metals which will perform satisfactorily in such temperatures have been concocted, provided they are of sufficient bulk, as to avoid erosion by the gasflow.

As is well known, the main gasflow surfaces of turbine blades are of aerofoil shape, ie they have a rounded leading edge, suction and pressure surfaces, and terminate in a trailing edge which is thin, relative to the leading portion of the aerofoil. Ideally, the trailing edge should be so thin, that the gasflows from the respective suction and pressure surfaces, on leaving the trailing edge, would flow therefrom in the form of a smooth wake. However, the need to avoid erosion dictates that the trailing edge be rounded, so much so, that the respective gasflows break away from the trailing edge, which reduces the base pressure on the trailing edge extremity, and causes generation of a stream of vortices. This undesirable effect occurs over the full length of the blade trailing edge, and consequently adversely affects the overall operating efficiency of the associated gas turbine engine.

SUMMARY OF THE INVENTION

The present invention seeks to provide an improved gas turbine engine turbine blade.

According to the present invention, a gas turbine engine turbine blade comprises an aerofoil, from the end extremity of the trailing edge of which there projects a plurality of elongate ceramic fibres, in a direction parallel with the mean direction of gasflows which leave said trailing edge during operation of said turbine blade in an associated gas turbine engine, said fibres being arranged in side by side relationship along at least a substantial portion of said trailing edge extremity.

The present invention further provides a method of fixing a plurality of ceramic fibres into the trailing edge portion of a turbine blade so as to protrude therefrom in a direction parallel with the mean direction of gasflows which leave said trailing edge of said turbine blade during operation in a gas turbine engine, comprising the steps of forming a slot in the blade trailing edge extremity, along at least a major portion of the trailing edge length, arranging a plurality of ceramic fibres in side by side relationship, directly or indirectly in said slot, and then squeezing the sides of said slot towards each other, so as to, directly or indirectly, trap and retain said ceramic fibres in the trailing edge portion of said turbine blade.

BRIEF DESCRIPTION OF PREFERRED EMBODIMENTS

The invention will now be described, by way of example, and with reference to the accompany drawings, in which.

DETAILED DESCRIPTION OF THE INVENTION

Figure 1:
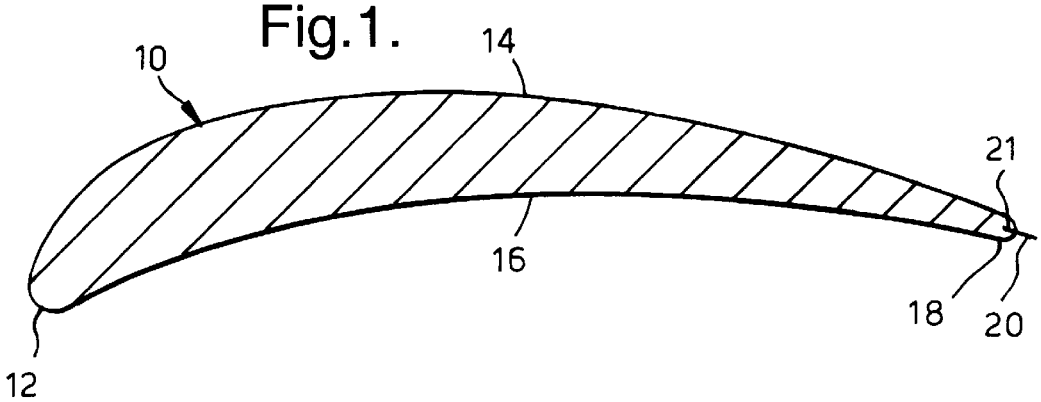
FIG. 1 is a cross sectional view through a turbine blade incorporating ceramic fibres in accordance with one example of the present invention.

Referring to FIG. 1, a turbine blade 10 has an aerofoil form, consisting of a rounded leading edge 12, a suction surface 14, a pressure surface 16, and rounded trailing edge 18. As can be seen in FIG. 1, the blade 10 tapers in a known manner, towards the trailing edge 18, the rounded portion thereof consequently being of considerably smaller radius than the leading edge 12.

In the example being described, a plurality of ceramic fibres 20, eg silicon carbide fibres, only one of which can be seen in FIG. 1, are embedded in the end extremity of the trailing edge 18, and protrude therefrom in a direction parallel with the mean direction of gasflows which leave the trailing edge 18, having passed over the respective suction and pressure surfaces 14 and 16, during use of the turbine blade 10 in an operating gas turbine engine (not shown).

Figure 3:
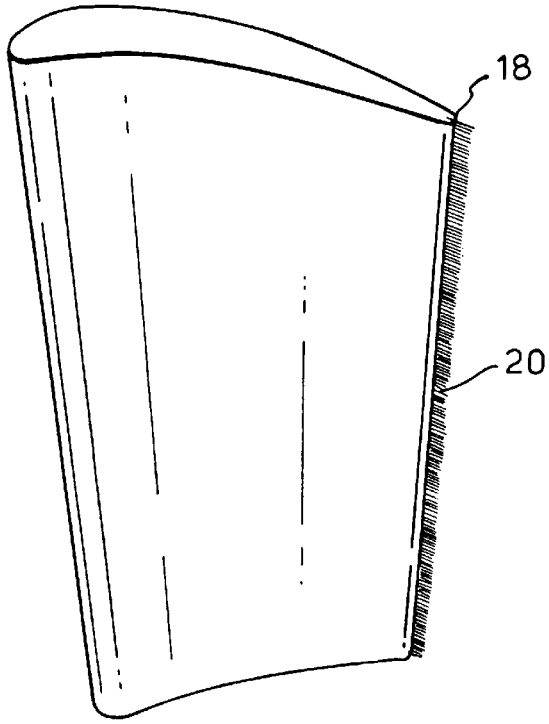
FIG. 3 is a pictorial view of the blade of FIG. 1, incorporating ceramic fibres in accordance with the present invention.

The ceramic fibres 20 are squeeze located in close, side by side relationship, in a slot along the length of the trailing edge 18, as is clearly seen in FIG. 3, so as to provide a fibrous wall, each side of which receives a respective flow of gas from the suction and pressure surfaces 14 and 16, of blade 10.

The rounded profile of the trailing edge 18, is a radical directional departure from the profile defined by surfaces 14 and 16, and a consequence of that change is that the gasflows break away from the blade 10. However, instead of immediately developing into strings of separate vortices, as in prior art conditions, the gasflows strike respective sides of the fibrous wall 20, and are deflected thereby onto a desired flow path, as unbroken flows. There results an efficient flow of gases into the following stage of the associated turbine (not shown).

Figure 2:
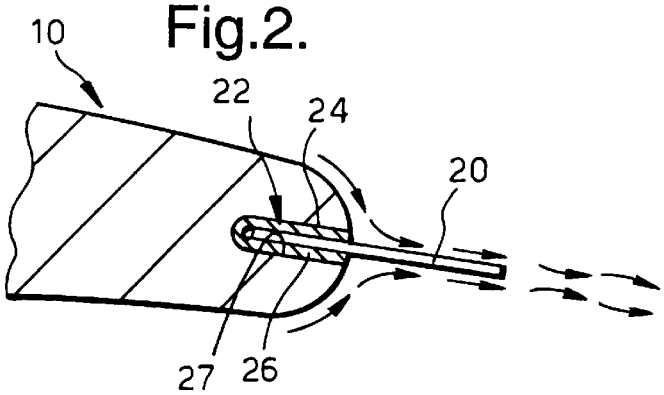
FIG. 2 is an enlarged view of the trailing edge of the blade of FIG. 1.

Referring to FIG. 2, an alternative method of fixing the ceramic fibres 20 in the blade 10, is achieved by forming a strip 22 of appropriate width and length, from metal which is compatible with the material from which blade 10 is manufactured, and folding the strip along its length. Ceramic fibres 20 are then inserted between the resulting opposing walls 24 and 26, which are then squeezed towards each other, so as to retain the fibres 20 therein. The strip 22 is then inserted in a pre-formed slot 27 in the extremity of the trailing edge 18, and the trailing edge sides squeezed towards each other, so as to retain the strip 22 therein.

Experiment has shown, that metals which are compatible with the metals from which turbine blades are manufactured, include the following: N75; N80; and Haynes 25.

Further experiment has indicated that the optimum extent of projection of the ceramic fibres 20 from the extremity of trailing edge 18, is in range 1.5 to 2.0 times the diameter thereof.

It is important, that the fit of the ceramic fibres, or the strip 22 in their respective slots in the trailing edge 18, is such that the resulting side portions thereof do not have to be moved, ie squeezed, more than 0.5% of the allowed normal correction, in order to satisfactorily grip the fibres.

We claim:

1. A gas turbine engine turbine blade comprising an aerofoil having a trailing edge, from the end extremity of which trailing edge which there projects a plurality of elongate ceramic fibres, in a direction parallel with the mean direction of gasflows which leave said trailing edge during operation of said turbine blade in an associated gas turbine engine, said fibres being arranged in side by side relationship along at least a substantial portion of said trailing edge extremity.

2. A gas turbine engine turbine blade as claimed in claim 1 wherein a slot is formed in the length of the extremity of the trailing edge thereof, said ceramic fibres being directly located in said slot.

3. A gas turbine engine turbine blade as claimed in claim 1 wherein a slot is formed in the length of the extremity of said trailing edge of said blade, said ceramic fibres being located in a folded strip of material, said strip being located in said slot.

4. A gas turbine engine turbine blade as claimed in claim 1 wherein said ceramic fibres are silicon carbide fibres.

5. A gas turbine engine turbine blade as claimed in claim 3 wherein the material from which said strip is made, is selected from the group consisting of: N75; N80 and Haynes 25.

6. A method of fixing a plurality of ceramic fibres into the trailing edge portion of a gas turbine engine turbine blade so as to protrude therefrom in a direction parallel with the mean direction of gasflows which leave said trailing edge of said turbine blade during operation in a gas turbine engine, comprising the steps of forming a slot in the blade trailing edge extremity, along at least a major portion of the trailing edge length, arranging a plurality of ceramic fibres in side by side relationship, directly or indirectly in said slot, and then squeezing the sides of said slot towards each other, so as to, directly or indirectly trap and retain said ceramic fibres in the trailing edge portion of said turbine blade.

7. A method of fixing a plurality of ceramic fibres into the trailing edge portion of a turbine blade as claimed in claim 6, wherein said ceramic fibres are arranged directly in said slot in said trailing edge, and the sides of said slot squeezed towards each other, so as to trap and retain said ceramic fibres therein.

8. A method of fixing a plurality of ceramic fibres into the trailing edge portion of a turbine blade as claimed in claim 7, including proportioning the dimensions of both slot and ceramic fibres, such that said slot sides provide sufficient grip thereon if squeezed up to 0.5% of the normally allowed movement to correct the blade shape.

9. A method of fixing a plurality of ceramic fibres into the trailing edge portion of a turbine blade as claimed in claim 6, wherein a strip of material which is compatible with the material from which said blade is made, is folded along its length to form opposing walls, between which said walls said ceramic fibres are then arranged in side by side relationship, and the walls thereafter squeezed, so as to trap and retain said ceramic fibres therein, and wherein a slot is formed in the trailing edge of said blade, for the receipt and gripping of said strip, by squeezing the sides of said slot towards each other.

10. A method of fixing a plurality of ceramic fibres into the trailing edge of a turbine blade as claimed in claim 9, including proportioning the dimensions of the blade slot and folded, squeezed strip, such that said blade slot sides provide sufficient grip thereon, if squeezed up to 0.5% of the normally allowed movement to correct the blade shape.

* * * * *